US005208958A

United States Patent [19]

Wilcox

[11] Patent Number: 5,208,958

[45] Date of Patent: May 11, 1993

[54] FASTENER NOSE ASSEMBLY WITH REARWARD JAW RELEASE

[75] Inventor: Robert B. Wilcox, Kingston, N.Y.

[73] Assignee: Huck Patents, Inc., Wilmington, Del.

[21] Appl. No.: 698,526

[22] Filed: May 10, 1991

[51] Int. Cl.[5] ..... B23P 19/04

[52] U.S. Cl. ..... 29/252; 72/391.8; 29/243.522

[58] Field of Search ..... 29/243.521, 243.522, 29/243.529, 243.53, 252; 72/391.2, 391.4, 391.8

[56] References Cited

U.S. PATENT DOCUMENTS

| | | | |
|---|---|---|---|
| 3,164,283 | 1/1965 | Olson | 29/252 |
| 3,314,136 | 4/1967 | Giles | 29/252 |
| 3,367,011 | 2/1968 | Sipher | 29/252 |
| 3,838,499 | 10/1974 | Fuller | 72/391.8 |
| 4,000,556 | 1/1977 | Ciminero | 29/252 |
| 4,249,293 | 2/1981 | Schulberg | 29/252 |
| 4,598,572 | 7/1986 | Mondello et al. | 72/391.2 |

*Primary Examiner*—J. J. Swann
*Attorney, Agent, or Firm*—Harness, Dickey & Pierce

[57] ABSTRACT

A nose assembly attachable to an actuating tool for pulling a pin type fastener through aligned holes in two or more workpieces includes a pin-engagement jaw structure that is locked to or unlocked from the fastener through a lost motion connection. A transverse pin that extends radially through a rear portion of the jaw structure and into an axial groove in an annular housing functions in response to axial motion of a collet member that is operated within the housing by a reciprocable piston in the actuation tool.

16 Claims, 2 Drawing Sheets

FASTENER NOSE ASSEMBLY WITH REARWARD JAW RELEASE

BACKGROUND OF THE INVENTION

1. Field of the Invention

This invention relates generally to an apparatus for pulling and setting fastener pins and particularly relates to a nose assembly having a release mechanism located in a rearward portion of the nose assembly for releasing a set of chuck jaws from engagement with the fastener pins.

2. Description of Prior Developments

Pin and collar fasteners of the lock bolt variety are commonly used to fabricate various frames and structures including aircraft wings and aircraft cabins. It is often desirable to produce an interference fit between the body of the pin and the members being fastened in order to produce a fatigue resistant joint by cold working the material surrounding the pin. This is particularly advantageous in the case of a fabrication requiring a leak-tight assembly such as an aircraft wing which also serves as a fuel tank, or an aircraft cabin which is subject to pressurization. While an interference fit can be clearly desirable in numerous applications, there has been a problem associated with its use.

In order to produce such an interference fit, it has been necessary to use a hammer or an air impact tool to force the fastener pin through a hole formed through each member being fastened. This hammering has resulted in excessive noise levels reaching up to 120 decibels. Hammering poses a threat to hearing and requires the use of ear protection. Another drawback associated with such hammering is that it often damages the head of the fastener pin and/or the members being fastened.

Setting fasteners by conventional techniques requires one assembler to initially position the pin through one exposed side of the workpiece and subsequently hammer the pin therethrough while a second assembly worker applies reinforcing support to the opposite side of the workpiece via a bucking bar. Thus, two workers are needed to carry out this labor intensive task using conventional methods.

A portion of the end of one type of fastener pin opposite its head is formed with a reduced radial section to allow that section of the pin to be freely inserted through the members being fastened. This exposes a short axial portion of the fastener pin prior to reaching the point of interference between a radially enlarged portion of the pin shank and the opposite or back face of the structure being fastened. Because interference fit fastener pins do not initially extend very far through the workpieces being fastened, a pin puller tool is needed which can adequately grip the relatively short axial length of the fastener pin which projects through the workpieces.

Of course, it is possible to make the noninterference fit portion of the fastener pin longer to provide a longer gripping surface. However, this results in considerable expense and material waste since this portion, which is commonly known as a pintail, is broken off and discarded when a collar or nut is subsequently swaged or fastened over the pin. This poses a particular problem in aircraft applications since the material used for the fastener pins in such applications is frequently titanium which is quite expensive.

Moreover, it is often not possible to use long fastener pins due to space limitations which prevent a fastener tool from accessing the elongated fastener pins. This is particularly true in the case of aircraft applications where structural channel members known as "J stringers" prevent the fastener tool from reaching and engaging those fastener pins located within the J stringer channels.

Accordingly, a need exists for a reliable nose assembly for use with a low noise level pin puller tool capable of gripping a short axial length of a fastener pin and quietly and smoothly pulling the fastener pin through an interference fit hole without damaging the fastener pin or the workpieces being fastened.

SUMMARY OF THE INVENTION

The present invention has been developed to meet the needs noted above and therefore has as a primary object the provision of a nose assembly adapted for use with a pneumatic or hydraulic tool for pulling fastener pins through an interference fit while generating negligible levels of noise. In order to securely grip the typically short axial length of the fastener pin which projects through an interference hole, the nose assembly of the present invention is provided with a set of gripping chuck jaws located within an associated collet member as the collet member applies an axial pulling force to the pin.

The jaws may be supported on an elongated elastomeric tube such that when the collet is moved toward a workpiece the elastomeric tube is axially restrained so as to hold the jaws in an open condition for encirclement around the projecting portion of the fastener pin. As the collet is drawn away from the workpiece the restraint is released, thereby enabling the jaws to be contacted by conical engagement surfaces on the collet. The jaws are thus radially closed around the fastener pin so that additional motion of the collet away from the workpiece draws the pin through aligned holes in the workpieces.

The nose assembly of this invention is designed so that when the collet is moving toward the workpiece the jaws are automatically opened and disengaged from contact with the collet as the collet reaches the limit of its stroke. As the collet starts its return stroke away from the workpiece the jaws are automatically compressed to a closed condition on the fastener pin. Only a very small motion of the collet is needed to open or close the jaws, approximately 0.1 inch. The jaw opening and closing mechanism is positive and quick-acting.

The nose assembly of the invention has as a principal feature a collet and jaw arrangement wherein the leading ends of the jaws are very near the end plane of the collet and anvil when the jaws are in the open position. This feature enables the nose assembly to be inserted over and around a comparatively short projecting portion of the fastener pin so that the pin does not have to project very far beyond the face of the workpiece in order for the nose assembly to achieve gripping contact with the pin.

Because of the manner in which the jaws are released from the pin, the collar swaging end face of conventional nose assembly anvils may be eliminated in nose assemblies designed for pulling only, thereby allowing the collet and jaws to be positioned closer to the fastener pin and workpieces than allowed by prior designs. In effect, the axial space previously required by the anvil end face is no longer required to provide a jaw release surface so that the collet and jaws of the present invention may be axially advanced over this space to gain a greater axial engagement with the fastener pin. This is a definite advantage over prior pull-only designs.

IN THE DRAWINGS

DETAILED DESCRIPTION OF A PREFERRED EMBODIMENT OF THE INVENTION

Figure 1:
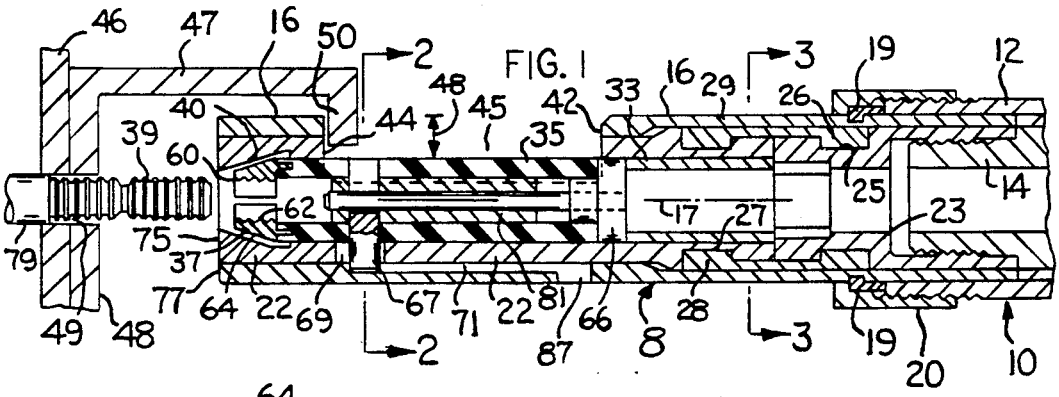
FIG. 1 is a longitudinal sectional view taken through a nose assembly embodying the invention.

The drawings show a nose assembly 8 attachable to an actuating tool body 10 that includes a cylinder 12 and a piston 14. A manual trigger associated with the tool body controls the flow of pressurized fluid such as air or oil to opposite end areas of piston 14, whereby the piston can effect reciprocatory motion within the cylinder. Tool body 10 may be a conventional known tool structure. The present invention is more particularly concerned with nose assembly 8.

In the first illustrated arrangement, nose assembly 8 is rotatable as a unit around the puller axis 17 of the tool (i.e. cylinder 12 and piston 14). The purpose of such relative rotation is to enable the human operator to comfortably grip the tool body while enabling a clearance space 45 on the nose assembly to face in any desired direction, according to clearance conditions defined by workpieces 46 and 47. A brief description of the rotary connections between nose assembly 8 and the puller tool is here given. However, it will be appreciated that the invention is not limited to rotary nose assemblies.

Rotary Connection Between The Tool Body and Nose Assembly 8

Nose assembly 8 is designed so that is can be manually rotated as a unit around its central longitudinal axis 17. The nose assembly includes an elongated tubular housing 16 somewhat analogous to anvil housings of prior designs and an elongated collet 22 that is slidable within housing 16 along axis 17. Collet 22, can slide axially but it cannot rotate relative to housing 16.

A side section of housing 16 is cut away, as at 42. Similarly, a side section of collet 22 is cut away, as at 44. These two cut away sections 42 and 44 are in circumferential alignment so as to form a clearance space 45 having a radial depth dimension 48. Clearance space 45 is useful in that it enables nose assembly 8 to extend into clearance spaces that are partially obstructed by overhanging portions of one of the workpieces.

FIG. 1 shows two workpieces 46 and 47, one of which has a somewhat J-shaped cross-sectional configuration that includes an overhanging flange 50. Clearance space 45 on nose assembly 8 enables the nose assembly to be axially aligned with holes 49 in the workpieces in spite of the presence of the obstruction provided by flange 50.

By making the nose assembly 8 rotatable as a unit relative to tool body 10, the clearance space 45 can be made to face in any desired circumferential direction as measured from axis 17. The actuating tool can thus be held in a comfortable position whatever the location of the obstruction 50, i.e. overhead or below or to one side of axis 17. The rotatable connection mechanism between tool 10 and nose assembly 8 is similar to the mechanism shown in co-pending patent application Ser. No. 563,134 filed on Aug. 6, 1990.

Housing 16 is rotatably connected to tool body cylinder 12 by a mechanism that includes a two piece split ring structure 19 seated in an annular groove in the housing surface. A nut 20 is threaded onto cylinder 12 to retain housing 16 on the cylinder, while enabling the housing to rotate around axis 17.

Collet 22 is rotatably connected to piston 14 by a mechanism that includes a tubular adaptor 23 threaded onto the piston. A two piece split ring structure 29 encircles the adaptor and the right end portion of collet 22. Inwardly extending flange 26 and 28 on ring structure 29 interact with annular grooves 25 and 27 in the adaptor and collet to axially lock the collet to the adaptor, while permitting the collet to rotate freely around axis 17.

Jaw Support Structure

Nose assembly 8 includes a segmental, three-piece, chuck-type jaw structure 37 attached to an elastomeric support tube 35. Jaw structure 37 may be constructed similarly to the jaw structure shown in U.S. Pat. No. 4,598,572. The jaw structure includes a tip end 60, internal annular ribs 62 adapted to engage grooves in a fastener pin 39, and outwardly-facing frusto-conical surfaces 64 adapted to nest within an internal frusto-conical engagement surface 40 on collet 22. The three jaw segments constituting the jaw structure are individually attached to elastomeric tube 35 such that the jaws can swing or deflect in radial planes around their tube connection points so as to open or close on the grooved section of fastener pin 39.

Elastomeric support tube 35 has its right end snugly fitted onto the reduced end section of a collar member 66 that abuts against a spacer tube 33 located within the right end portion of collet 22. Near its left end, elastomeric tube 35 is formed with two diametrically aligned circular openings that snugly receive therein a transverse cylindrical pin 67. The pin is located with its upper end (FIG. 1) at the outer side surface of the tube 35. The other end portion of the pin extends downwardly through an axial clearance slot 69 in the wall of collet 22 into an axial groove 71 in the tubular wall of housing 16. Groove 71 interacts with pin 67 to prevent relative rotation between collet 22 and housing 16.

Locking The Jaws Onto The Fastener Pin

Figure 4:
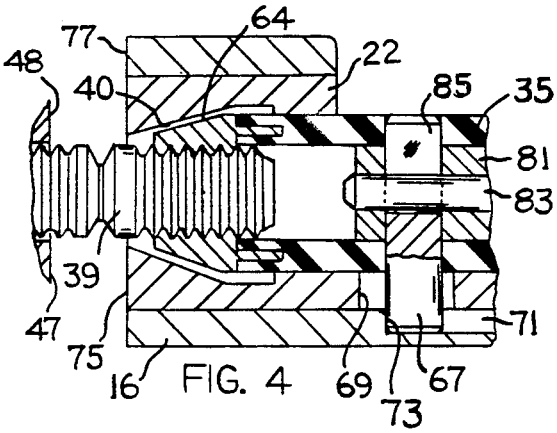
FIG. 4 is an enlarged fragmentary transverse sectional view showing a front portion of the nose assembly gripping a fastener pin.

As seen in FIGS. 1 and 4, pin 67 has its left or front side surface in engagement with a shoulder 73 formed at the left end of groove 71. FIG. 1 shows collet 22 in a position at the limit of its leftward travel in housing 16, as determined by the position of piston 14 in cylinder 12. The radial end surface 75 of collet 22 is in radial alignment with the exposed end edge 77 of housing 16. The coplanar relationship between collet end surface 75 and anvil exposed edge 77 is believed to be an important advantage over prior designs. The nose assembly is intended to pull a partially inserted fastener pin 39 through aligned holes 49 in two or more workpieces, such that the cylindrical section 79 of the pin has an interference fit with the hole edges. The housing 16 includes an exposed end edge 77 in coaxial and radial alignment with collet end surface 75 when the collet is at the leftward limit of its travel (FIG. 1).

The housing-collet relationship is such that the nose assembly can be inserted over the grooved section of a fastener pin so that when the housing 16 is advanced as far as possible along and over the pin length the collet will undergo essentially the same axial travel and reach the same axial position as the housing reaches along and over the pin surface. This means that the collet and associated jaw structure can be effectively inserted or telescoped onto fastener pins having relatively short projected lengths, i.e. pins with only short sections located beyond the right face 48 of workpiece 47 in FIGS. 1, 4 and 5. In the FIG. 1 position, the forward tip end 60 of jaw structure 37 is only a slight distance to the right of axially recessed behind collet end surface 75, such that ribs 62 on the jaw structure are in position to achieve an extensive axial grasp on even relatively short exposed pin sections.

The relationship between transverse pin 67 and shoulder 73 at the left end of groove 71 is such that when piston 14 reaches its leftmost position in cylinder 12, the elastomeric support tube 35 to the rear of pin 67 will be in a slightly axially compressed condition. That is, as piston 14 moves leftwardly toward the FIG. 1 position, pin 67 strikes shoulder 73. A slight additional leftward motion of piston 14 and attached collet 22 causes spacer tube 33 and collar 66 to apply an axial force on the right end of elastomeric tube 35. Pin 67 abuts against shoulder 73 such that tube 35 is slightly squeezed axially between the transverse pin and collar member 66.

FIG. 1 shows the nose assembly and jaws in an opened condition prior to insertion onto the projecting portion of an associated fastener pin 39. Jaw actuator surfaces 64 are axially disengaged from jaw engagement surface 40 so that when the nose assembly is inserted onto the fastener pin, the ribs 62 on the jaws can easily ride over the ribs on the fastener pin. FIG. 4 shows the nose assembly in position on the fastener pin wherein the jaws are still in an opened condition, in the sense that they do not have a high pressure grip on the pin.

Figure 5:
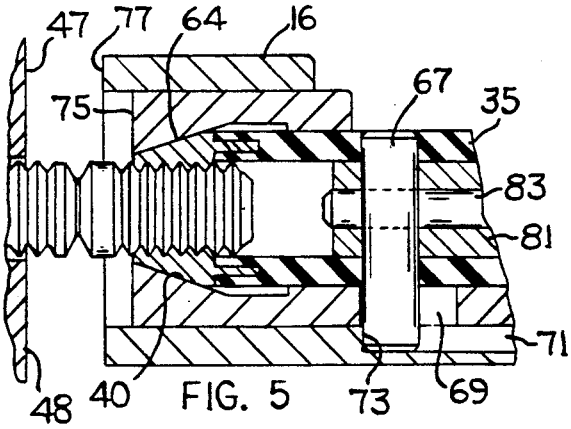
FIG. 5 is a view taken in the same direction as FIG. 4, but illustrating the nose assembly in a different condition relative to the associated fastener pin.
Figure 3:
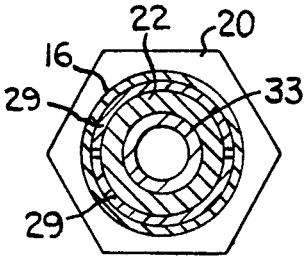
FIG. 3 is a transverse sectional view taken on line 3—3 in FIG. 1.

FIG. 5 shows the nose assembly after piston 10 has just started its rightward stroke. Collet 22 has its jaw engagement surface 40 in contact with jaw actuator surfaces 64 so that the jaws cannot then be disengaged from the fastener pin. During the initial piston stroke from FIG. 4 to FIG. 5, collet 22 moves a slight distance rightwardly without any corresponding movement of jaw structure 37. Typically this slight movement is only about 0.1 inch. In the FIG. 5 position, elastomeric tube 35 is in an essentially uncompressed relaxed condition while jaw structure 37 is initially undergoing radial compression and receiving axially rearwardly directed forces from collet 22.

Further rightward motion of collet 22 by piston 10 causes the fastener pin to be pulled through the aligned holes in the workpieces. Cylinder 12 and housing 16 reactively move to the left, such that end edge 77 of the anvil abuts against the workpiece face to provide an anchorage point for the nose assembly.

Releasing The Jaws From The Fastener Pin

To disengage the nose assembly from the fully projected and inserted fastener pin the tool piston is operated forwardly or leftwardly to the FIG. 4 condition. Upon initial disengagement, collet 22 moves leftwardly to the FIG. 5 position, so that pin 67 strikes shoulder 73, to thereby halt the axial movements of tube 35 and apply to it a slight compressive force. As the collet continues to move to the left, the jaws 37 are disengaged from the engagement surfaces 40. When the FIG. 4 position is reached, the tool and nose assembly can be readily removed from the fastener pin with a light axial pull.

In a preferred embodiment of the invention, elastomeric tube 35 is reinforced against radial or transverse buckling, especially during pin pulling. FIG. 1 shows a rigid cylindrical core member 81 extending along and within tube 35 to prevent tube buckling.

Limiting Insertional Movement of The Jaws Onto The Fastener Pin

When the tool is manipulated to move jaws 37 onto the fastener pin it is desired that the jaws only grip the area of the pin to the right of breakneck groove 38 (FIG. 4). In order to prevent the jaws from possibly being inserted too far onto the pin there is provided an axially elongated rigid rod 83 which extends from collar 66 through tube 35 and through a slot 85 in transverse pin 67. The left end of rod 83 serves as an abutment for possible engagement with the end of the fastener pin so as to limit insertional motion of jaws 37 onto the fastener pin.

Figure 2:
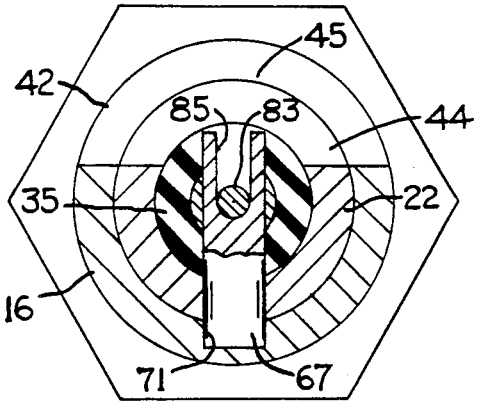
FIG. 2 is an elongated transverse sectional view taken on line 2—2 in FIG. 1.

In the manufacture of the illustrated nose assembly the jaw structure and elastomeric support tube 35 are installed into collet 22 prior to installation of housing 16 onto the collet. Pin 67 is installed after the housing has been partially telescoped over the collet. An installation hole 87 is formed through the wall of housing 16 at the right end of groove 71. When the housing is in a location on collet 22 wherein hole 87 is in radial alignment with the transverse holes in tube 35, the pin 67 is inserted through hole 87 so that its slot 85 fits over rod 83 in the manner of a yoke as shown in FIG. 2. Housing 16 is then further telescoped onto the collet to the operative condition. During normal operation of the nose assembly, hole 87 is beyond the limits of travel of pin 67. Hole 87 is only an installation device, not an operating device.

Features of The Invention

A principal feature of the invention is the action of pin 67 in groove 71, such that the pin responds to leftward movement of collet 22 to axially halt the movement of elastomeric support tube 35, thereby enabling the jaw actuator surfaces 64 to be operatively disengaged from jaw engagement surface 40. Collet 22 and pin 67 are oriented to groove 71 so that during the initial portion of collet movement in the rightward or rearward direction, the jaw actuator surfaces 64 are engaged with the jaw engagement surface 40 on the collet.

The jaw locking-unlocking action is achieved without any motion of the jaw structure along the fastener pin surface. The jaw structure remains virtually motionless. Axial motion of the collet to lock or unlock the jaw structure is relatively slight, typically only about 0.1 inch. This means that the jaw structure can have its tip end very near the collet end surface 75, such that the fastener pin does not have to project very far from the workpiece surface in order for the jaw structure to make effective contact with the pin.

Alternative Embodiments of The Invention

Figure 6:
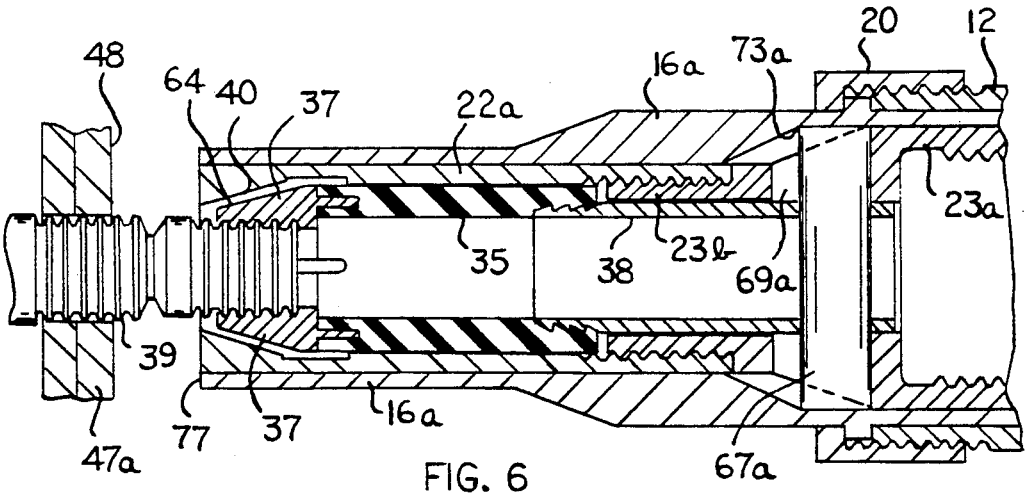

FIG. 6 illustrates an embodiment of the invention wherein the nose assembly has a fixed, non-rotary, connection to the pin-puller tool 10. Additionally, the FIG. 6 embodiment lacks the side clearance feature represented by numeral 48 in FIG. 1. The FIG. 6 nose assembly includes an internally threaded annular adaptor 23*a* configured to be threaded onto the piston portion of the tool. The adaptor has a reduced diameter end section 23*b* having a threaded fit within a tubular collet 22*a*. A transverse slot 69*a* extends through the adaptor 23*a*.

An annular housing 16*a* is securable onto the cylinder portion 12 of pin-puller tool 10 by means of a nut 20. With the described arrangement housing 16*a* moves with the cylinder portion 12 of the tool, whereas collet 22*a* moves with the piston portion of the tool.

A three-piece segmental chuck jaw structure 37 is connected to a rigid slidable tubular liner 38 via an elongated elastomeric support tube 35. Ribs on the left end of liner 38 fit into grooves in tube 35 to retain the tube on the liner. Tube 35 can be molded onto the liner and onto the end portions of the jaws to form a unitary subassembly. A cylindrical pin 67*a* extends transversely through liner 38 and slot 69*a* in adaptor 23*a*.

When the components are in the FIG. 6 position just as collet 22*a* has completed its forward stroke, pin 67*a* abuts against an internal shoulder 73*a* on housing 16*a* to halt the forward motion of liner 38 and tube 35 so as to disengage jaws 37 from conical surface 40 of collet 22*a*. FIG. 6 shows jaws 37 loosely engaged on the ribs of a fastener pin 39.

In this position, the pin may be easily pulled out of the jaws with a light axial force, or the pin may be easily inserted into the jaws, depending upon whether the pin has already been pulled through the workpieces, or is about to be pulled through. End edge 77 of housing 16*a* is spaced from workpiece 47*a*. Rightward movement of the tool piston causes collet 22*a* to move rightwardly. At this time, slot 69*a* provides a lost motion connection between the collet and pin 67*a*, such that liner 38 and tube 35 initially remain motionless. Lost motion between the collet and liner 38 enables collet engagement surface 40 to effect pressure engagement against actuator surfaces 64 of the jaws as well as to allow for pin release.

Continued rightward movement of the tool piston causes the jaw structure to pull the fastener pin 39 through the aligned holes in the workpiece. End surface 77 of housing 16*a* abuts against surface 48 of workpiece 47*a*to anchor nose assembly to the workpiece. The nose assembly can be disengaged from the fastener pin by moving the tool piston leftwardly to the position shown in FIG. 6. Pin 67*a* responds to leftward motion of collet 22*a* toward the workpieces to shift rightwardly in slot 69*a*, thereby disengaging jaw structure 37 from collet surface 40 upon engagement with shoulder 73*a* as discussed above.

Axial motion of collet 22*a* to lock jaw structure 37 to the collet (or unlock the jaw structure from the collet) is relatively slight, typically on the order of 0.1 inch. The arrangement of FIG. 6 has many of the advantages of the FIG. 1 structure, including the ability to effectively grip fastener pin 39 when only a relatively short section of the pin is projecting through surface 48 of workpiece 47*a*.

FIG. 7 Embodiment

Figure 7:
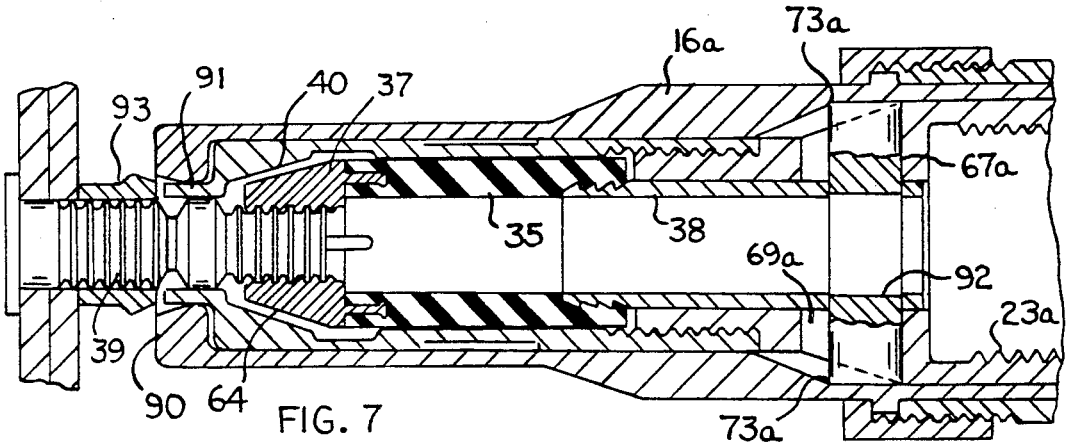
FIGS. 6 and 7 are longitudinal sectional views taken through other devices embodying features of the invention.

FIG. 7 shows the FIG. 6 construction modified for use as a device to set the fastener pin after its insertion through two aligned holes in the workpieces. Modification of the FIG. 6 structure includes an annular, radially-extending flange or anvil 90 on the left end of housing 16*a*, and an additional tubular extension or ejector 91 on the left end of collet 22*a*. A hole 92 is formed through release pin 67*a* for accommodation of a pintail that is severed from pin 39 during the fastener setting operation.

Prior to operation of the FIG. 7 device, a fastener collar 93 is placed on the projecting portion of the fastener pin 39. With the device in the FIG. 7 position, the piston portion of the tool is powered rightwardly so that collet surface 40 shifts into engagement with jaw surfaces 64, thereby locking the collet and jaw structure on the fastener pin. With the collet locked to pin 39, housing 16*a* is caused to shift leftwardly so that its flange 90 exerts an axial force on collar 93. Flange 90 travels over the collar surface to swage the collar material into the circumferential grooves in pin 39, thereby locking the collar onto the pin for securement of the workpieces. Subsequently the right end portion of pin 39 is severed and propelled in a rightward direction.

The operation of the FIG. 7 device is generally similar to operation of corresponding prior art devices, e.g. the device shown in U.S. Pat. No. 4,598,572, except for the action of transverse pin 67*a*. During the initial portion of the rearward piston stroke, pin 67*a* remains abutted against shoulder 73*a* of the housing, such that jaw structure 37 stays in place on fastener pin 39 until collet surface 40 can engage the jaw structure to lock the jaw structure onto the fastener pin.

The drawings show presently preferred embodiments of the invention. However, it is to be understood that various changes and modifications may be made thereto without departing from the spirit of the invention.

I claim:

1. A nose assembly for gripping and pulling a fastener pin positioned within a workpiece and for use with a tool member actuable for applying a relative axial force to said nose assembly, said nose assembly comprising:

a generally elongated tubular housing having an axially extending bore with a generally central axis;

a collet slidably and telescopically located within said bore of said housing, said collet having an internal jaw engagement surface;

connecting means for connecting said housing and said collet to the tool member whereby actuation of the tool member causes relative axial movement of said collet within said bore of said housing in response to said relative axial force from the tool member;

a segmented jaw structure located within said collet, said jaw structure having outwardly-facing actuator surfaces for engaging said jaw engagement surface;

support means extending axially relative to said axis of said bore for supporting said jaw structure; and release means responsive to said relative axial movement of said collet within said bore of said housing toward said workpiece for halting movement of said jaw structure and for axially disengaging said jaw structure from said jaw engagement surface, said release means extending radially between said support means and said housing for abutting engagement therebetween.

2. The nose assembly of claim 1, wherein said release means comprises a radially extending release pin extending from said jaw support means through said collet, and a radial shoulder located in said housing to engage said release pin when said collet is moving toward said workpiece.

3. The nose assembly of claim 2, further comprising a clearance slot located in said collet in encircling relation to said release pin.

4. The nose assembly of claim 3, wherein said axially-extending support means comprises an elastomeric tube and wherein said radial pin extends transversely through said tube.

5. The nose assembly of claim 4, further comprising a rigid rod member extending axially and within said elastomeric tube.

6. The nose assembly of claim 4, further comprising a rigid rod extending axially through said elastomeric tube to limit insertional movement of said jaw structure onto said fastener pin.

7. The nose assembly of claim 1, wherein said radially extending end surface of said collet is in radial planar alignment with said end edge of said housing when said jaw structure is axially disengaged from said jaw engagement surface.

8. The nose assembly of claim 7, wherein said jaw-engagement surface is a frusto-conical surface extending directly from the radially-extending end surface of said collet.

9. The nose assembly of claim 1, wherein said axially-extending support means comprises an elastomeric tube; said release means comprising a release pin extending transversely through said elastomeric tube and said collet, and an axial groove in said housing, said groove having a shoulder portion and said release pin having one end thereof located in said groove so that when said collet is moving toward said workpiece said release pin will engage said shoulder and apply an axial halting force to said elastomeric tube.

10. The nose assembly of claim 9, wherein said collet has a clearance slot arranged in encircling relation to said release pin.

11. The nose assembly of claim 10, wherein said housing and said collet have registering cutaway sections extending therealong, said cut-away sections forming a work clearance space that enables said nose assembly to clear overhanging wall portions of said workpiece.

12. A nose assembly for use with a fastener pin puller tool having a piston disposed within a cylinder portion of said tool for reciprocating, axial movement within said cylinder portion in response to actuation of said tool, comprising:

an annular elongated housing having an axially extending bore with a generally central axis and an internal engagement surface within said bore;

first connecting means for connecting said housing to said cylinder portion of said tool, an annular collet being slidably mounted within said bore of said housing and having an internal jaw-engagement surface;

second connecting means for connecting said collet to said piston of said tool whereby actuation of said tool and reciprocating axial movement of said piston causes relative axial movement of said collet within said bore of said housing;

a segmented jaw structure located within said collet for releaseably gripping a fastener pin, said jaw structure having outwardly-facing actuator surfaces for engaging said jaw-engagement surface of said collet;

support means extending axially relative to said axis of said bore for supporting said jaw structure within said collet;

release means responsive to movement of said collet within said housing toward said fastener pin for halting movement of said jaw-structure and for axially disengaging said jaw structure from said jaw engagement surface, said release means extending radially between said support means and said housing for abutting engagement therebetween;

said release means comprising a transverse engagement member operatively associated with said support means; said engagement member extending radially into axial registry with said internal engagement surface of said housing; said transverse engagement member constituting a lost motion connection between said collet and said jaw structure support means, whereby said jaw structure can be locked to the fastener pin with a relatively short axial motion of said collet.

13. The nose assembly of claim 12, wherein said axially-extending support means comprises an elastomeric tube and wherein said transverse engagement member comprises a transverse pin extending through said elastomeric tube.

14. The nose assembly of claim 12, wherein said axially-extending support means comprises a liner member slidable within said collet and wherein said transverse engagement member extends through said liner member.

15. The nose assembly of claim 12, wherein said housing and said collet have radially extending end surfaces that are coplanar when said jaw structure is disengaged from said jaw-engagement surface of said collet.

16. The nose assembly of claim 15, wherein said jaw-engagement surface is a frusto-conical surface extending directly from said radial end surface of said collet.

* * * * *